US005503214A

United States Patent [19]

Cribley et al.

[11] Patent Number: 5,503,214

[45] Date of Patent: Apr. 2, 1996

[54] MOLD AND METHOD FOR CASTING A DISK BRAKE ROTOR

[75] Inventors: Donald L. Cribley, Muskegon; Thomas E. Prucha, Brighton; Robert R. Fors, Muskegon, all of Mich.

[73] Assignee: CMI International, Inc., Southfield, Mich.

[21] Appl. No.: 222,541

[22] Filed: Apr. 4, 1994

[51] Int. Cl.[6] ..... B22C 9/10

[52] U.S. Cl. ..... 164/134; 164/358; 164/137; 164/339; 164/369

[58] Field of Search ..... 164/358, 134, 164/137, 339, 365, 366, 367, 368, 369, 57.1, 58.1, 340

[56] References Cited

U.S. PATENT DOCUMENTS

| | | | |
|---|---|---|---|
| 2,138,624 | 4/1937 | Campbell et al. | 164/340 |
| 2,150,510 | 3/1939 | Jeune | 164/358 |
| 2,876,509 | 3/1959 | Gardner | 164/134 |
| 3,080,628 | 3/1963 | Sundin | 164/358 |
| 3,433,293 | 3/1966 | Ponzar | 164/358 |
| 3,435,885 | 5/1966 | Burke et al. | 164/134 |
| 4,154,289 | 5/1979 | Jeanneret | 164/358 |
| 4,807,728 | 2/1989 | Suenaga et al. | 188/260 |
| 4,832,105 | 5/1989 | Nagan et al. | 164/61 |
| 4,913,218 | 4/1990 | Seidinger | 164/358 |
| 4,928,746 | 5/1990 | Butler et al. | 164/362 |

FOREIGN PATENT DOCUMENTS

| | | |
|---|---|---|
| 656453 | 7/1946 | Australia . |
| 51-44515 | 4/1976 | Japan . |
| 56-26657 | 3/1981 | Japan . |
| 0127132 | 8/1982 | Japan . |
| 0149625 | 7/1986 | Japan . |
| 63-52744 | 3/1988 | Japan . |
| 2235549 | 9/1990 | Japan . |
| 3110060 | 5/1991 | Japan . |
| 0137730 | 8/1992 | Japan . |
| 6614353 | 6/1967 | Netherlands . |

*Primary Examiner*—P. Austin Bradley
*Assistant Examiner*—Randy Herrick
*Attorney, Agent, or Firm*—Howard & Howard

[57] ABSTRACT

A casting mold assembly includes cope and drag sections having a casting cavity therebetween and a casting core supported within the cavity. A vertical down sprue extends through the cope section and joins a flow passage extending through the core in prolongation of the down sprue for introducing molten metal directly into the mold cavity to produce a disk brake rotor. A filter is supported in the flow path of the core and a flow control lip is provided at the exit of the flow path to provide a flow constricting gap between the annular lip and an underlying lower cavity wall to slow the flow of metal into the cavity.

30 Claims, 2 Drawing Sheets

MOLD AND METHOD FOR CASTING A DISK BRAKE ROTOR

TECHNICAL FIELD

This invention relates generally to foundry metal casting and more particularly to casting core constructions and methods for casting a disk rotor of a braking system.

BACKGROUND OF THE INVENTION

Disk brake rotors for automotive applications have in the past and still are fabricated of cast iron utilizing conventional foundry casting techniques in which molten iron is gravity cast into a mold cavity formed between separable sand mold halves through a conventional gating system encircling the cavity having one or more ingates extending into the cavity for introducing the molten metal therein.

More recently, however, automotive manufacturers are looking to alternatives to conventional cast iron brake rotors and have found aluminum metal matrix composite material to be a suitable alternative, providing increased performance and wear and a significant reduction in weight as compared to their cast iron counterparts. Such aluminum metal matrix material, however, is very costly in comparison and more difficult to cast. Consequently, the gating arrangement conventionally employed for casting iron brake rotors may not be used to cast aluminum metal matrix composite rotors, since aluminum is poured at a lower temperature and has a tendency to cool to an unacceptably low pouring temperature in the gating system as well as picking up unacceptably high levels of hydrogen and other impurities before entering the cavity. Even if such a gating system could be used, however, the scrap metal material remaining in the gating system would render the usage of such aluminum matrix composite material cost prohibitive.

Cast aluminum composite brake rotors thus far have been produced by direct pouring the molten composite material into the cavity through a down sprue. No gating system is used. The temperature of the composite material is maintained and hydrogen pickup minimized. A filter is usually placed in the down sprue to trap oxides, slag, and other impurities from entering into the mold. Typical of such known direct pour systems is disclosed in U.S. Pat No. 4,928,746 to Butler et al, granted May 29, 1990. A ceramic foam filter is fixed inside a sleeve of refractory material that lines the down sprue of the mold. Such a sleeve/filter arrangement has been used in the past to produce brake rotors. The sleeve and filter joined to the mold by either inserting the sleeve into a down sprue of a prefabricated upper cope section, or else the sleeve is joined in situ with the making of the cope section. The cope section is joined to a drag section along a horizontal parting plane. The cope section has a central hub-forming portion projecting into the drag section to produce a corresponding central hub portion of the brake rotor. The sprue extends through the central hub portion into the mold cavity. A ring-shaped core is printed into the drag section and encircles the hub-forming portion for producing a ventilated disk portion of the rotor.

During formation of the cope section in which mold sand is rammed into a mold box around the refractory sprue sleeve, the sleeve may flex radially inward when subjected to the ramming forces causing a gap to be formed between the sleeve and the sprue wall. Such a gap is undesirable as it allows metal to flow around the sleeve thereby bypassing the filter to the detriment of casting quality. Such sleeves also have a tendency to shift downward during or after formation of the cope section under their own weight or when handled causing the lower end to extend beyond the cope section further into the mold cavity than designed, thereby narrowing the gap clearance between the exit of the down sprue and the underlying mold cavity wall of the drag section. It is important that this gap be carefully controlled since it governs the flow rate of molten metal into the mold cavity.

SUMMARY OF INVENTION AND ADVANTAGES

A casting mold assembly for casting metal articles comprises a casting mold having an upper cope section and a lower drag section joined together along a generally horizontal parting plane and having mutually spaced upper and lower cavity walls defining a casting cavity therebetween. The cope section has a down sprue extending generally vertically downward from the top of the cope section directly into the mold cavity for introducing molten metal directly into the casting cavity. A casting core has a flow passage extending axially through the core between an inlet end at a top surface of the core and an outlet end at a bottom surface of the core. The core is supported in the casting cavity with the inlet end of the flow passage aligned in direct fluid communication with the sprue and with the outlet end spaced above the lower cavity wall for passing the molten metal through the core into the cavity.

A method of casting a disk brake rotor of the type having a disk portion and an integral central hub portion is also contemplated using the characteristic features of the mold assembly above. The method includes the steps of forming a casting mold having upper and lower mold sections joined at a generally horizontal parting plane and including upper and lower cavity wall portions spaced to define a casting cavity therebetween corresponding in shape to the brake rotor to be cast therein and including a down sprue extending generally vertically downward through the upper mold section directly into the mold cavity.

A rotor core is formed of reducible refractory material having a central hub-defining portion of generally cylindrical configuration and an integral air cooling passage-forming portion encircling said hub-forming portion and including a flow passage extending through the hub-defining portion having an upper metal inlet end and a lower metal outlet end. A filter element is inserted into the flow passage, and the rotor core and filter element assemblage is disposed in the casting cavity with the metal inlet end of the flow passage aligned with the down sprue establishing fluid communication therebetween and with the hub-defining portion of the core and the metal outlet end of the flow passage spaced from the lower cavity wall. Molten metal is poured into the sprue and through the flow passage and filter directly into the casting cavity and allowed to solidify thereby producing a resultant cast metal brake rotor within the cavity.

The above mold assembly and method eliminates the need for a refractory sprue liner simplifying the casting process, reducing production cost, and eliminating the aforementioned problems associated with the sleeve. Pouring the metal through the flow passage of the core rather than the cope, enables closer tolerance and repeatability of the flow gap between the outlet of the flow passage and the lower cavity wall, with a resultant increase in productivity, higher casting quality, and lower scrap production and cost.

BRIEF DESCRIPTION OF THE DRAWINGS

These and other features and advantages of the invention will become more readily understood and appreciated by those skilled in the art when considered in connection with the following detailed description and drawings, wherein.

DETAILED DESCRIPTION

Figure 2:
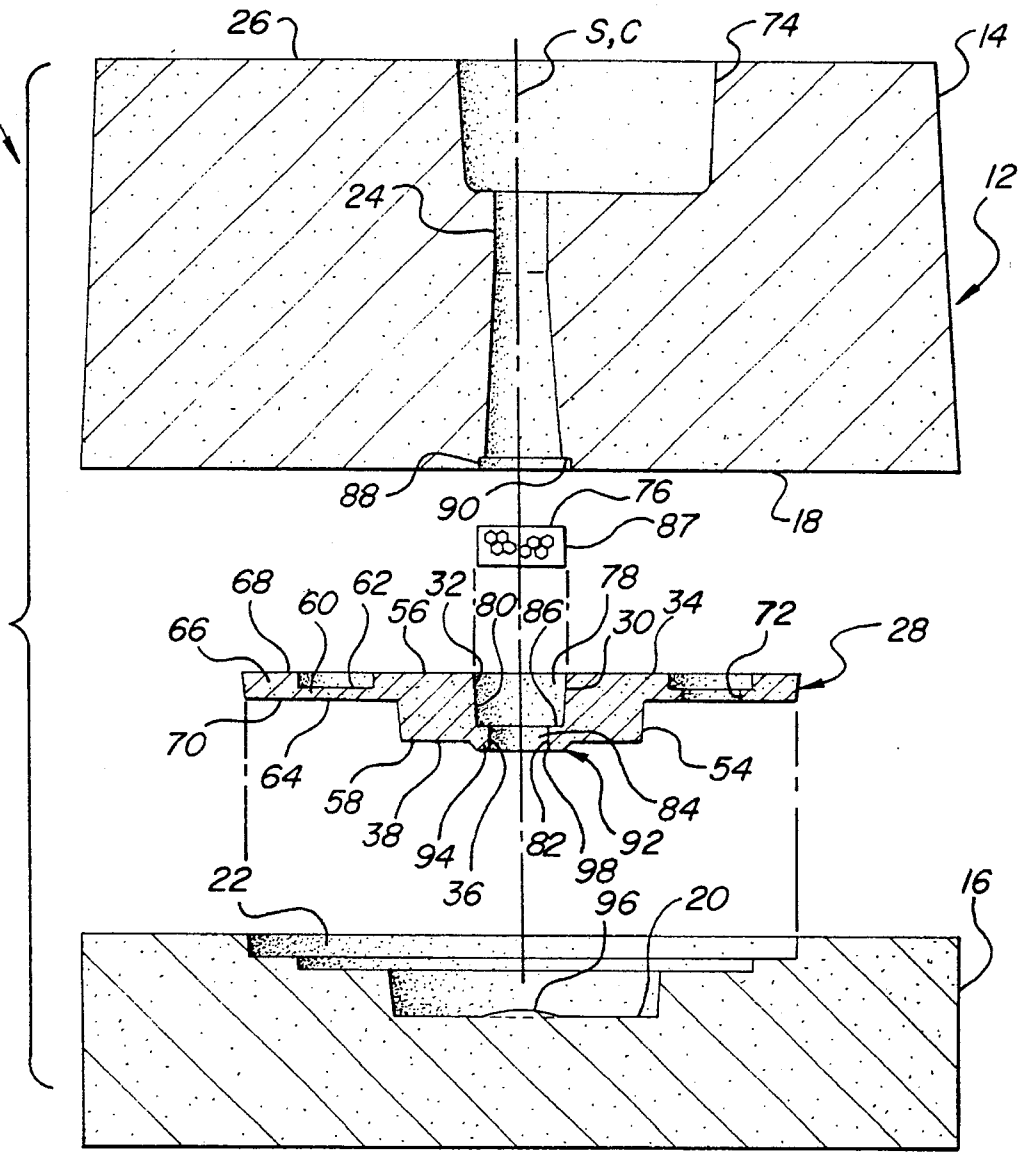
FIG. 2 is an exploded front sectional view of the mold assembly.
Figure 1:
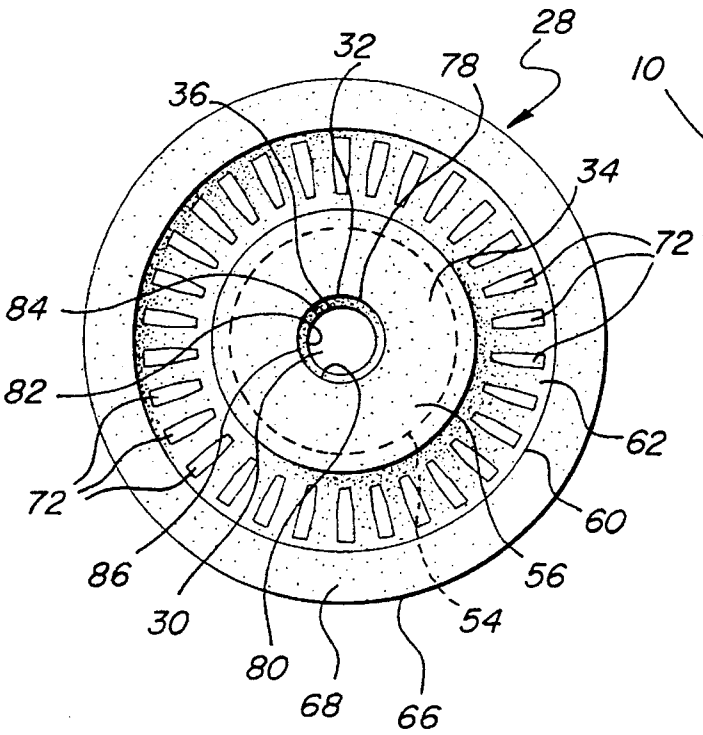
FIG. 1 is a bottom view of the rotor core.

A casting mold assembly constructed in accordance with a presently preferred embodiment of the invention is designated in the drawings generally by the reference character 10 and comprises a casting mold 12 and preferably a sand mold prepared according to conventional foundry practice, having an upper mold half or cope section 14 and a separate lower mold half or drag section 16 joined along a generally horizontal parting plane P and having mutually spaced upper 18 and lower 20 cavity wall portions defining a casting cavity 22 therebetween.

A down sprue 24 extends completely through the cope section from a top surface 26 thereof downward along a central vertical axis S to the upper cavity wall 18 providing the sole means of introducing molten metal directly into the casting cavity. No gating system is utilized between the sprue and the cavity, but rather molten metal is fed directly into the casting cavity 22 from the sprue 24. One or more down sprues 24 may be utilized, the preferred embodiment requiring only one such down sprue 24, as shown in the drawings.

A casting core 28 is disposed in the cavity 22 and is provided with a flow passage 30 that extends completely through the core 28 between a metal inlet end 32 at a top surface 34 of the core 28 and a metal outlet end 36 at a bottom surface 38 of the core 28.

The casting core 28 is preferably constructed from conventional reducible refractory material such as chemically bonded core sand utilizing conventional core making techniques.

Figure 3:
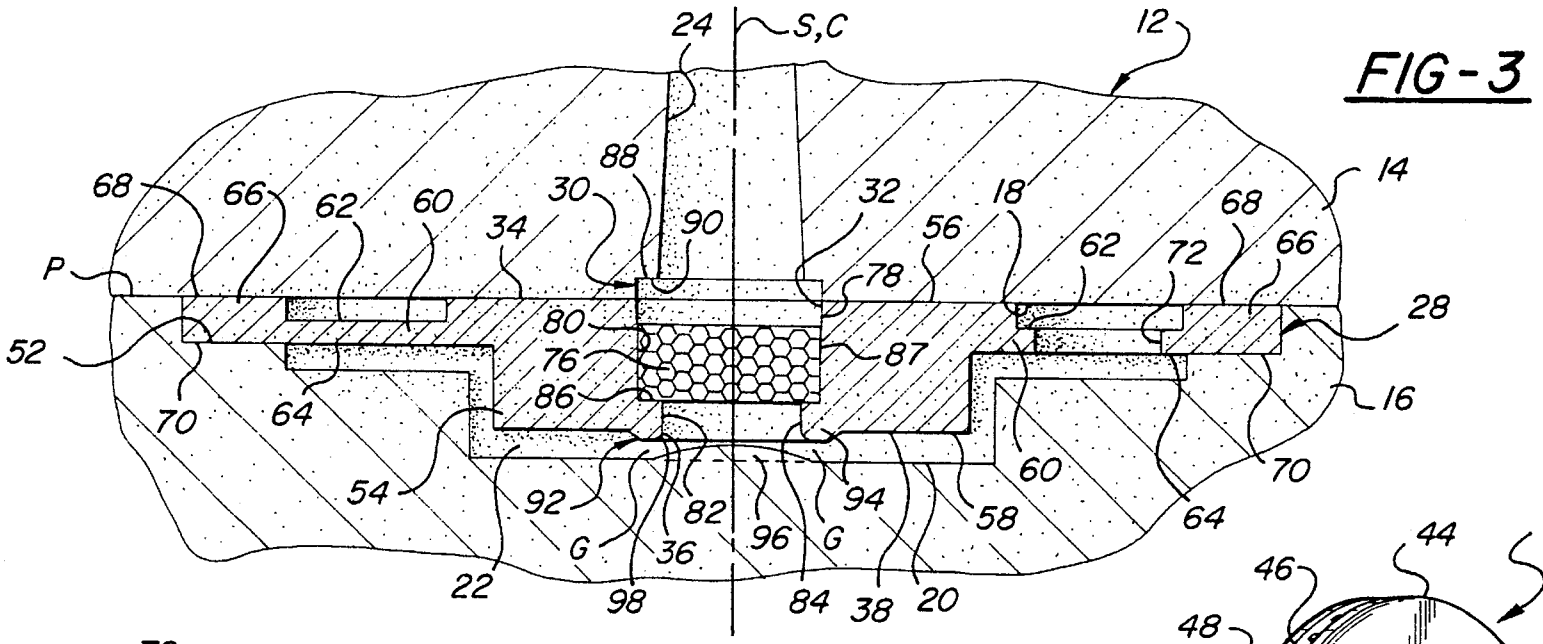
FIG. 3 is an enlarged fragmentary sectional view of the assembled mold components.

As shown best in FIG. 3, the core 28 is supported in the casting cavity 22 occupying and preserving a space within the cavity 22 that is not to be filled with molten metal and being supported, at least in part, in spaced relation to the mold cavity walls 18, 20 defining therebetween an unoccupied space within the cavity 22 to be filled with molten metal and corresponding in size and shape to the article to be cast. In the particular embodiment, the casting core 28 and cavity walls 18, 20 are configured to produce a ventilated disk brake rotor of conventional construction, designated generally by the reference numeral 40 in FIG. 5, of the type typically used in many automotive braking systems.

Figure 5:
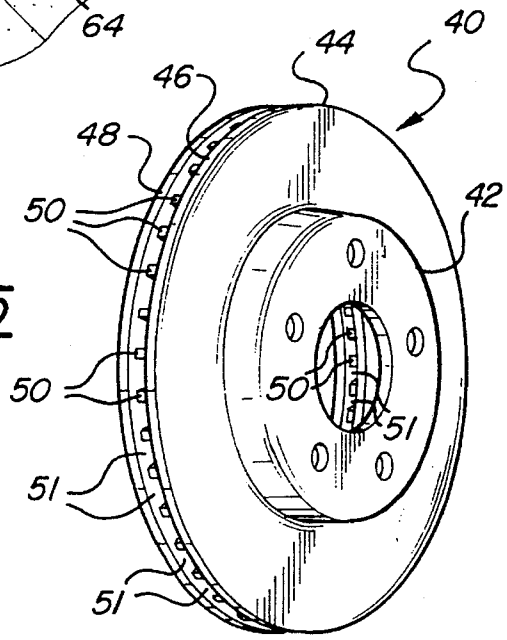
FIG. 5 is a perspective view of a brake rotor cast in accordance with the present invention.

As illustrated in FIG. 5, the brake rotor 40 has a cup-shaped mounting hub portion 42 for mounting the rotor 40 to a vehicle's wheel axle assembly (not shown) and a ventilated brake disk portion 44 having a pair of spaced apart outer 46 and inner 48 disk halves provided for engagement by a pair of corresponding brake pads (not shown) for slowing the travel of the vehicle. The outer 46 and inner 48 disk halves are interconnected by a plurality of circumferentially spaced, radially extending ventilating ribs, some of which are designated by the reference numeral 50 in FIG. 5 providing therebetween a corresponding plurality of circumferentially spaced and radially extending air cooling passages, some of which are designated by the reference numeral 51 in FIG. 5. The invention could also be used to produce other articles, such as brake drums.

As mentioned, the casting cavity walls 18, 20 and core 28 are arranged relative to one another to provide an unoccupied space in the cavity 22 corresponding in size and shape to the disk brake rotor 40 of FIG. 5. To provide such an unoccupied space in the cavity 22, the cope section 14 of the mold 12 is provided with an annular ring-shaped core print depression 52 encircling the casting cavity 22 concentrically about the sprue axis S. The casting core 28 has a central hub-defining portion 54 having a generally cylindrical shape arranged symmetrically about a central core axis C. The hub-defining portion 54 includes a generally planar upper surface 56 and a generally planar parallel lower surface 58 spaced from one another and arranged normal to the core axis C. The flow passage 30 extends through the hub-defining portion 54 concentrically with the core axis C. In other words, the flow passage 30 extends linearly and vertically through the hub-defining portion 54 having its axis concentric with the central axis of the core C with its metal inlet end 32 provided at the upper surface 56 of the hub-defining portion 54 and its metal outlet end 36 adjacent the lower surface 58 of the hub-defining portion 54.

An air cooling passage-forming portion 60 of the core 28 is formed integrally with the hub-defining portion 54 and encircles the hub-defining portion 54 to produce the aforementioned air cooling passages 51 of the brake disk portion 44 of rotor 40. The air cooling passage-forming portion 60 is annular and disk-shaped having an upper planar surface 62 parallel to but spaced below the upper surface 56 of the hub-defining portion 54, and a lower planar surface 64 spaced above the lower surface 58 of the hub-defining portion 54 and parallel to both the lower surface 58 of the hub-defining portion 54 and the upper surface 62 of the air cooling passage-forming portion 60. The air cooling passage-forming portion 60 is substantially thinner than the hub-defining portion 54.

The rotor core also includes a core print projection in the preferred form of an annular flange or ring 66 encircling the air cooling passage-forming portion 60 and having an upper planar surface 68 co-planar with the upper surface 56 of the hub-defining portion 54 and a lower surface 70 co-planar with the lower surface 64 of the air cooling passage-forming portion 60 and formed as a radial extension thereof. A plurality of circumferentially spaced, radially extending apertures 72 are provided in the air cooling passage-forming portion 60 extending between the upper 62 and lower 64 surfaces thereof for forming the associated air cooling ribs 50 of the brake rotor 40.

As shown best in FIG. 3, the core print projection 66 of the rotor core 28 is received in the correspondingly shaped core print depression 52 of the drag section 16 supporting the lower surfaces 58, 64 of the hub-defining portion 54 and air cooling passage-forming portion 60 spaced above the lower cavity wall 20 defining an unoccupied portion of the casting cavity 22 corresponding in size and shape to the mounting hub 42 and outer half brake disk portion 46 of the brake rotor 40. As also shown best in FIG. 3, the upper cavity wall 18 defined by a bottom surface of the cope section 14 overlying the lower cavity wall 20 is planar and horizontal. The planar upper cavity wall 18 lies in the parting plane P with no portion of the upper cavity wall 18 extending below the parting plane P into the drag section 16. The upper cavity wall 18 is spaced above the upper surface 62 of the air cooling passage-forming portion 60 defining an unoccupied upper cavity portion corresponding in size and shape to the inner disk half 48 of the brake rotor 40.

As mentioned, the hub-defining portion 54, air cooling passage-defining portion 60 and core print projection 66 are each symmetrical about the central core axis C and arranged concentrically about the core axis C. The core 28 is supported in the cavity 22 with the flow passage 30 extending in linear prolongation of the down sprue 24 such that the core axis C is collinear with the sprue axis S. The upper surface 56 of the hub-defining portion 54 engages the bottom surface 18 of the cope section 14 supporting the metal inlet end 32 of the flow passage 30 in direct alignment and engagement with the exit end of the down sprue 24 so that metal exiting the down sprue 24 must enter the flow passage 30 prior to entering the unoccupied space within the cavity 22. The engagement of the the top surface of the casting core and hub-defining portion 54 of the core 28 provides a seal between the flow passage 30 and down sprue 24 assuring that metal does not flow around the core 28 but rather only through the flow passage 30 on entry into the cavity. In this way, the flow passage 30 provides a direct continuous linear extension of the down sprue 24 together providing an inlet into the mold cavity that is substantially linear, vertical, and normal to the lower cavity wall 20.

The down sprue 24 includes a pouring basin or sprue cup 74 recessed into the top 26 of the cope section 14.

The mold assembly 10 also includes a filter element 76 supported within a filter pocket 78 of the flow passage 30 for filtering the metal passing through the flow passage 30 on entry into the cavity 22. The filter element 76 may be any of a number of filter types commonly used in the metal founding industry, but preferably comprises a cellular ceramic foam filter of the type available from Foseco International Limited, Birmingham, England, under the trademark SIVEX®. The construction of the preferred filter element 76 includes an open cell polyurethane foam impregnated with a ceramic material and binder. The filter 76 slows the flow of metal into the mold and removes impurities such as aluminum oxides and dross which, if allowed to enter the casting cavity 22, would serve as nucleation sites for porosity defects caused by hydrogen gas coming out of solution on cooling of the metal. The preferred metal material for producing the disk brake rotor 40 is an aluminum metal matrix composite material grade SAE 930179 available from Duralcan.

The filter pocket 78 comprises an enlarged recess extending into the hub-defining portion 54 of the casting core 28 from the top surface 34 thereof along the axis C of the flow passage 30. The pocket 78 has side walls 80 that are larger in diameter than side walls 82 of a lower portion 84 of the flow passage 30 provided between the filter pocket 78 and the bottom surface 38 of the core 28. The transition from the filter pocket 78 to the lower flow passage portion 84 provides an abrupt annular ridge or shoulder 86 at the bottom of the filter pocket 78. The shoulder 86 faces toward the metal inlet end 32 and extends into the flow passage 30 from the filter pocket side walls 80 defining a filter seat 86 spaced a fixed distance above the bottom surface 38 of the core 28 which engages the bottom surface of the filter element 76 adjacent its outer peripheral edge to thereby support the filter element 76 in spaced position above the bottom surface 38 of the core 28. The side walls 80 of the filter pocket 78 are frusto-conical in shape and narrowingly tapered from a large diameter end at the inlet of the flow passage 30 to a relatively smaller diameter end at the filter seat 86. The narrowing taper of the side walls 80 enables the filter element 76 to be received into the filter pocket 78 against the filter seat 86.

As illustrated best in FIG. 3, the filter element 76 has an outer peripheral wall 87 corresponding in frusto-conical shape to the side walls 80 of the filter pocket 78 so that when the filter element 76 is inserted into the pocket 78 and seated against the filter seat 86, the outer wall 87 of the filter element 76 is wedged into snug engagement with the side walls 80 of the pocket. It will be understood, of course, that the filter element 76 is inserted into the pocket 78 prior to assembling the mold sections 14 and 16. The snug fit of the filter element 76 in the pocket 78 helps keep the filter element 76 in place and assures that all of the metal passes through the filter element 76 before entering into the mold cavity 22.

Once the filter element 76 is placed in the filter pocket 78 and the cope and drag sections 14, 16 assembled, the filter element 76 is retained within the pocket by filter retaining means 88 overlying the filter pocket 78 and spaced from the filter seat 86 for engaging and maintaining the filter element 76 in position within the pocket during pouring. The filter retaining means 88 comprises an enlarged recess extending into the bottom surface of the cope section 14 concentric with the down sprue 24 and forming an extension of the filter pocket 78 into the cope section 14. The filter retaining recess 88 has an annular ridge or shoulder 90 extending radially inward from a peripheral wall of the enlarged recess 88 opposite to the filter seat 86 of the filter pocket 78. The shoulder 90 overlies the filter element 76 and limits upward movement of the filter element 76 beyond the shoulder 90.

The central positioning of the down sprue 24 and flow passage 30 with respect to the symmetrical casting cavity 22 allows metal to be directed into the casting cavity 22 at a central location for even flow distribution throughout the cavity. Because the metal outlet end 36 of the flow passage 30 is spaced above the lower cavity wall 20, the metal flowing out of the outlet end 36 will flow into the unoccupied space of the cavity 22 in all radial directions. To better control the rate at which the metal flows into the cavity 22, the casting core 28 is provided with flow control means 92 for controlling the rate of flow of metal into the cavity 22. The flow control means 92 comprises an annular constriction or flow control gap G provided between the metal outlet end 36 of the core 28 and the lower cavity wall 20 for slowing the flow of metal into the cavity 22 than would otherwise occur if the flow constriction were not present.

The flow control gap G is formed in part by the provision of an annular lip 94 encircling the metal outlet end 36 of the flow passage 30 and projecting downwardly beyond the bottom planar surface 38 of the core 28 so that its outer extremity is nearer to the lower cavity wall 20 than is an immediate surrounding bottom surface portion of the casting core 28, such that the spacing between the lip 94 and the lower cavity wall 20 is relatively smaller than the corresponding spacing between the lower planar surface 38 of the core 28 and the lower cavity wall 20.

In addition to controlling the rate of flow of metal into the cavity 22, it is desirable to reduce the turbulence of the metal entering the cavity to minimize entrainment of oxides and impurities that may be present in the mold assembly and to minimize hydrogen pickup, both of which are detrimental to the soundness and quality of the casting. The central axes S, C of the sprue 24 and flow passage 30 are perpendicular to the lower cavity wall 20. To ease the flow of metal into the cavity 22, an upwardly convex hump or protrusion 96 having the shape of a segment of a sphere is provided to a portion of the lower cavity wall 20 directly underlying the metal outlet end 36 of the flow passage 30. Upon striking the convex protrusion 96, the vertically downward flow of molten metal is caused to be redirected radially outward of the central axis S into the unoccupied space in the cavity 22.

Figure 4:
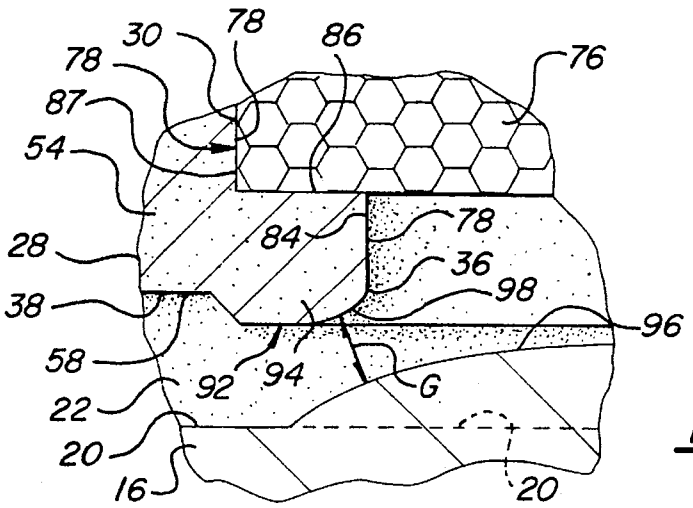
FIG. 4 is an enlarged fragmentary sectional view of the mold assembly.

As shown best in FIG. 4, the convex protrusion 96 cooperates with the annular lip 94 to further narrow the flow control gap G presented to the metal flow on entry into the mold cavity 22. The relative size and spacing of the annular lip 94 and convex protrusion 96 may be adjusted to obtain the desired metal flow rate. Since the core 28 is printed into the drag section 16 and supported in position by engagement of the core print projection 66 and core print depression 52, precise repeatable control of the size of the flow control gap G is attainable from mold to mold. In other words, the drag section 16 has both the core print depression 52 and the lower cavity wall 20 arranged in fixed relative position and the core 28 has both the core print projection 66 and annular lip 94 arranged in fixed relative position. Precise control of the flow control gap size can thus be controlled with accurate repeatability by simply locating the core 28 in the cavity 22 with the core print projection 66 supported in the core print depression 52.

The outlet end 36 of the flow passage 30 is also provided with an annular peripheral mouth 98 that is convexly curved outwardly at a junction of the flow passage 30 and the annular lip 94. The radiused shape of the mouth 98 assists in easing the flow of metal into the cavity 22 to minimize turbulence.

To make a brake rotor casting 40 according to a preferred embodiment of this invention, the components of the mold assembly 10 are fabricated and arranged in the manner described above and molten metal (preferably aluminum metal matrix composite described above) is poured into the sprue cup 74, down sprue 24, through the flow passage 30 and filter element 76, and into the unoccupied space within the casting cavity 22, filling the casting cavity 22 with the molten metal. On entry into the mold cavity 22, the metal is passed through the flow control gap G provided by the flow control means 92 described above to thereby constrict and slow the flow of metal into the cavity to minimize turbulence. The metal is allowed to solidify in the cavity 22, flow passage 30, and down sprue 24 and then removed from the mold 12 in conventional manner along with the core 28. The solidified metal in the down sprue 24 and flow passage 30 is broken off from the remaining casting to prepare the casting for further processing.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A casting mold assembly for casting metal articles, said assembly comprising:

a casting mold (12) having an upper cope section (14) and a lower drag section (16) joined together along a generally horizontal parting plane (P) and having mutually spaced upper (18) and lower (20) cavity walls defining a casting cavity (22) therebetween, said cope section (14) having a down sprue (24) extending generally vertically downward from a top (26) of said cope section (14) directly into said casting cavity (22) for introducing molten metal directly into said casting cavity (22); and a casting core (28) having a flow passage (30) extending axially through said core (28) between an inlet end (32) at a top surface (34) of said core (28) and an outlet end (36) at a bottom surface (38) of said core (28) and supported in said casting cavity (22) with said inlet end (32) aligned in direct fluid communication with said down sprue (24) and said outlet end (36) spaced above said lower cavity wall (20) for passing the molten metal through said core (28) into said cavity (22), a filter element (76) disposed in said flow passage (30) of said casting core for filtering the molten metal passing through said flow passage (30) on entry into said cavity (22).

2. The assembly of claim 1 wherein said filter element (76) is a cellular ceramic foam.

3. The assembly of claim 1 wherein said down sprue (24) and said flow passage (30) are collinear.

4. The assembly of claim 1 wherein at least a portion of said top surface (34) of said core encircling said inlet end (32) of said flow passage (30) is supported in engagement with said cope section (14) of said mold (12).

5. The assembly of claim 1 wherein said casting core (28) is fabricated of reducible refractor material for producing a disk brake rotor having a ventilated disk portion and an integral central hub portion, said core (28) having a central hub-defining portion (54) of generally cylindrical configuration and an integral air cooling passage-forming portion (60) encircling said hub-forming portion (54) and including a core print projection (66) engaging said lower drag section (16) of said mold (12) and supporting said hub-defining portion (54) and said air cooling passage-defining portion (60) in spaced relation to said cavity walls (18, 20) defining an unoccupied space in said cavity (22) corresponding in size and shape to the hub and disk portions of the brake rotor to be produced, said air cooling passage-forming portion (60) occupying and preserving a space within said cavity (22) for producing a plurality of air cooling passages within the disk portion of the brake rotor, said hub-forming portion (54) including said flow passage (30).

6. The assembly of claim 5 wherein said core (28) includes a filter seat (86) extending transversely into said flow passage (30) and supporting said filter element (76) spaced above said outlet end (36).

7. The core construction of claim 6 wherein said flow passage (30) includes a filter pocket (78) having frustro-conical shaped side walls (80) narrowingly tapered from a large diameter end at said inlet end (32) of said flow passage (30) to a relatively smaller diameter end, said filter seat (86) including an annular shoulder projecting radially inwardly of said filter pocket side walls (80) at said smaller diameter end of said filter pocket (78) and facing said inlet end (32) of said flow passage (30), said filter element (76) having a frusto-conical outer wall (87) corresponding in size and shape to that of side walls (80) of said filter pocket (78) for insertably receiving said filter element (76) into said pocket (78) against said filter seat (86).

8. The assembly of claim 7 wherein said down sprue (24) has filter retaining means (88) overlying said filter pocket (78) and spaced from said filter seat (86) for engaging and maintaining said filter element (76) in position within said filter pocket (78).

9. The assembly of claim 8 wherein said filter retaining means (88) comprises an annular shoulder (90) within said down sprue (24).

10. The assembly of claim 5 wherein said outlet end (36) of said flow passage (30) includes flow control means (92) for constricting the flow of metal into said cavity (22).

11. The assembly of claim 10 wherein said flow control means (92) comprises a flow control gap (G) fixed between said outlet end (36) of said flow passage (30) and an adjacent underlying portion of said lower cavity wall (20).

12. The assembly of claim 11 wherein said hub-defining portion (54) of said core (28) has a generally planar bottom surface (58) and said flow control means (92) comprises an annular lip (94) encircling said outlet end (36) of said flow passage (30) and projecting downwardly out of the general plane of said bottom surface (58) toward said adjacent underlying portion of said lower cavity wall (20).

13. The assembly of claim 12 wherein said lower drag section (16) has a core print depression (52) engaging said core print projection (66) of said core (28) and supporting said annular lip (94) a predetermined distance above said underlying portion of said lower cavity wall (20) defining said flow control gap (G) therebetween.

14. The assembly of claim 12 wherein said outlet end (36) of said flow passage (30) has an annular peripheral mouth (98) that is convexly curved at a junction of said flow passage (30) and said annular lip (94).

15. The assembly of claim 12 wherein said underlying portion of said lower cavity wall (20) comprises a convex protrusion (96) located directly beneath said flow passage (30) and extending upwardly toward said annular lip (94).

16. The assembly of claim 5 wherein said air cooling passage-forming portion (60) includes a disk surrounding said hub-defining portion (54) and having generally planar upper (62) and lower (64) surfaces, said lower surface (64) being spaced from an adjacent portion of said lower cavity wall (20) for forming a first outer half of the disk portion of the brake rotor, said upper surface (62) being spaced from said upper cope section (14) for forming a second inner half of the disk portion of the brake rotor, and including a plurality of circumferentially spaced radially extending apertures (72) extending through said disk between said upper (62) and lower (64) surfaces thereof for forming a corresponding plurality of circumferentially spaced fins joining the first and second halves of the disk portion and separating the plurality of air cooling passages of the brake disc rotor.

17. The assembly of claim 16 wherein said core print projection (66) comprises an annular flange (66) encircling said disk of said core 28.

18. The assembly of claim 1 wherein said outlet end (36) of said flow passage (30) and an adjacent underlying portion (96) of said lower cavity wall define flow control means (92) for choking the flow of metal into said cavity (22).

19. The assembly of claim 18 wherein said flow control means (92) comprises an annular flow constricting gap (G) provided between said outlet end (36) of said flow passage (30) and said underlying portion (96) of said lower cavity wall (20).

20. The assembly of claim 19 wherein said flow constricting gap (G) includes an annular lip (94) encircling said outlet end (36) of said flow passage (30) and projecting downwardly beyond a bottom surface (38) of said core (28) toward said underlying portion (96) of said lower cavity wall (20).

21. The assembly of claim 21 wherein said underlying portion (96) of said lower cavity wall (20) comprises a convex protrusion (96) located directly beneath said flow passage (30) and extending upwardly toward annular lip (94) and spaced therefrom to define said flow constricting gap, said flow constricting gap (G) being narrower in transverse section than an immediate surrounding portion of said cavity (22) such that the flow of molten metal from said flow passage (30) into said surrounding cavity portion is constricted through said flow constricting gap (G).

22. The assembly of claim 21 wherein said drag section (16) includes a core print depression (52) adjacent said cavity (22) and said core (28) includes a core print projection (66) received in said core print depression (52) to positively locate said annular lip (94) in predetermined spaced relation to said underlying portion (96) of said cavity wall (20) to define said flow constricting gap (G) therebetween.

23. The assembly of claim 20 wherein said outlet end (36) of said flow passage (30) has an annular peripheral mouth (98) that is convexly curved at a junction of said flow passage (30) and said annular lip (94).

24. A casting mold assembly for casting a metal disk brake rotor of the type having a ventilated disk portion and an integral central hub portion, said mold assembly comprising:

a casting mold (12) fabricated of reducible refractory material having an upper cope section (14) and a lower drag section (16) joined together along a generally horizontal parting plane (P) and having mutually spaced upper (18) and lower (20) cavity walls defining a contoured casting cavity (22) therebetween, said cope section (14) having a down sprue (24) extending from a top (26) of said cope section (14) generally vertically downward directly into said cavity (22) along a sprue axis (S) for introducing molten metal directly into said cavity (22), said drag section (16) having a core print depression (52) encircling said cavity (22); and a rotor core (28) fabricated of reducible refractory material having a hub-defining portion (54) of generally cylindrical configuration extending along a central core axis (C) between opposite upper (56) and lower (58) ends thereof, a flow passage (30) extending through said hub-defining portion (54) along said core axis (C) between an inlet end (32) at said upper end (56) of said hub-defining portion (54) and an outlet end (36) at said lower end (58) for receiving the passage of molten metal through said hub-forming portion (54) directly into the cavity (22), a filter element (76) disposed within said flow passage (30) of said rotor core for filtering the molten metal passing through said flow passage (30) on entry into the cavity (22), an integral air cooling passage-forming disk portion (60) encircling said hub-defining portion (54) adjacent said upper end (56) thereof, and a core print projection (66) extending about said disk portion (60) and received in said core print depression (52) of said drag section (16), said flow passage (30) extending in axially aligned prolongation of said down sprue (24) to receive the molten metal through said flow passage (30) into said cavity (22), said hub-defining portion (54) supported above said lower cavity wall portion (20) providing an unoccupied space within said cavity (22) corresponding to the hub portion of the brake rotor to be cast, said disk portion (60) spaced from both said upper (18) and lower (20) cavity wall portions providing first and second unoccupied spaces within said cavity (22) corresponding to inner and outer halves of the disk portion to be cast, said disk portion (60) including a plurality of radially extending circumferentially spaced apertures (72) extending through said disk portion (60) for forming a plurality of correspondingly-shaped air cooling passages within the disk of the brake rotor.

25. The assembly of claim 24 wherein said flow passage (30) includes a filter pocket (78) having a frusto-conical shaped side wall (80) narrowingly tapered from a large diameter end at said inlet end (32) of said flow passage (30) to a relatively smaller diameter end, and a filter seat comprising an annular shoulder (86) projecting radially inwardly of said filter pocket side wall (80) at said smaller diameter end of said filter pocket (78) and facing said inlet end (32) of said flow passage (30), said filter element (76) having a frusto-conical outer wall (87) corresponding in size and shape to that of side walls (80) of said filter pocket (78) for insertably receiving said filter element (76) into said pocket (78) against said filter seat (86).

26. The assembly of claim 24 including an annular lip (94) encircling said outlet end (36) of said flow passage (30) and projecting beyond said lower end (58) of said hub-defining portion (54) toward said lower cavity wall portion (20), said lower cavity wall portion (20) comprising a convex protrusion (96) located directly beneath said annular lip (94) and extending upwardly beyond said lower cavity wall portion (20) toward said rotor core (28), said annular lip (94) and said convex protrusion (96) defining an annular flow constricting gap (G) therebetween.

27. A method of casting a disk brake rotor having a disk portion and an integral central hub portion, said method comprising the steps of:

forming a casting mold (12) having upper (14) and lower (16) mold sections joined at a generally horizontal parting plane (P) and including upper (18) and lower (20) cavity wall portions spaced to define a casting cavity (22) therebetween corresponding in shape to the brake rotor to be cast therein, and a down sprue (24) extending generally vertically downward through the upper mold section (14) directly into the cavity (22);

forming a rotor core (28) of reducible refractory material having a central hub-defining portion (54) of generally cylindrical configuration and an integral air cooling passage-forming portion (60) encircling said hub-forming portion (54) and a flow passage (30) extending through said hub-defining portion (54) having an upper metal inlet end (32) and a lower metal outlet end (36);

inserting a filter element (76) into the flow passage (30) of said rotor core;

supporting the rotor core (38) and filter element (76) assemblage in the cavity (22) so that the metal inlet end (32) of the flow passage (30) aligns with the down sprue (24) establishing fluid communication therebetween, and further so that the hub-defining portion (54) of the core (28) and the metal outlet end (36) of the flow passage (30) is spaced from the lower cavity wall (20); and pouring molten metal into the down sprue (24) and through the flow passage (30) and filter (76) directly into the cavity (22) and allowing the molten metal to solidify thereby producing a resultant cast metal brake rotor within the cavity (22).

28. The method of claim 27 including passing the flow of metal through a flow constricting gap (G) formed between the metal outlet end (36) and the lower cavity wall (20).

29. The method of claim 27 where the inserting a filter element into the flow passage includes the steps of forming a filter pocket (78) within the flow passage (30) having a frustro-conical shaped side wall (80) narrowingly tapered from a large diameter end at the inlet end (32) of the flow passage (30) to a relatively smaller diameter end, forming a filter seat (86) projecting radially inwardly of the filter pocket side wall (80) at the smaller diameter end of the filter pocket (78) and facing the inlet end (32) of the flow passage (30), providing the filter element (76) with a frusto-conical outer wall (87) corresponding in size and shape to that of the walls (80) of the filter pocket (78), and inserting the filter element (76) into the filter pocket (78) against the filter seat (86).

30. The method of claim 27 including casting an aluminum matrix composite material into the mold as the metal.

* * * * *